US006036218A

United States Patent [19]

Muff, Jr.

[11] Patent Number: 6,036,218

[45] **Date of Patent: *Mar. 14, 2000**

[54] SNOW BOARD TIP PROTECTOR

[76] Inventor: William H. Muff, Jr., 2292 Quail, Lakewood, Colo. 80215

[ * ] Notice: This patent issued on a continued prosecution application filed under 37 CFR 1.53(d), and is subject to the twenty year patent term provisions of 35 U.S.C. 154(a)(2).

[21] Appl. No.: 08/962,797

[22] Filed: Nov. 3, 1997

[51] Int. Cl.[7] ..... A63C 5/052

[52] U.S. Cl. ..... 280/608; 280/14.2

[58] Field of Search ..... 280/610, 608, 280/809, 816, 14.2, 18

[56] References Cited

U.S. PATENT DOCUMENTS

| | | | |
|---|---|---|---|
| 2,225,293 | 12/1940 | Bjork | 280/11.13 |
| 3,355,183 | 11/1967 | Kneissl | 280/11.13 |
| 3,424,469 | 1/1969 | Hooker | 280/11.13 |
| 3,580,596 | 5/1971 | Volkl | 280/11.13 |
| 4,047,735 | 9/1977 | Ferch | 280/610 |
| 4,409,287 | 10/1983 | Harrison | 280/610 |
| 5,242,322 | 9/1993 | Chellemi et al. | 280/608 |
| 5,664,808 | 9/1997 | Whidden et al. | 280/809 |
| 5,871,224 | 2/1999 | Vance | 280/608 |

*Primary Examiner*—Eric Culbreth
*Assistant Examiner*—David R. Dunn
*Attorney, Agent, or Firm*—Holland & Hart LLP

[57] ABSTRACT

A ski device such as a snow board is disclosed which has a tip protector embedded into the upper surface of each of the tip portions of the board. The tip protector may be incorporated into regular ski tips or mono-ski tips as well as on snow boards. The tip protector is a generally flat curved strip of ductile sheet material bonded to a portion of the upper surface of the rounded tip portion adjacent to and aligned with the edge of the device.

19 Claims, 2 Drawing Sheets

SNOW BOARD TIP PROTECTOR

BACKGROUND OF THE INVENTION

1. Field of the Invention

This invention relates generally to snow boards and snow skis, and more particularly to a tip protection apparatus for the ends of the snow boards or skis.

2. Description of the Related Art

Modern snow skis and snow boards are typically made of laminations of different layers of materials to provide the desired performance characteristics. These layers may include metal, wood, plastic, fiberglass, and/or graphite materials bonded together to form a single ski or snow board structure. Often, when a rider hits a rock or a tree with the board or ski, the tip is the first thing that gets damaged. On a snow board, the potential for damage is double as there are two tips on the board. Both tips of the board are generally narrower in thickness and prone to being the impact points with rocks and trees. When the board tips are hit, the tip bends and the thin top lamination tends to begin to delaminate or peel up.

One solution to this problem is to provide a removable rubber bumper or "nose guards" that are adhesively fastened to the board and fit over the snow board tips to prevent such damage to the actual laminated tips. These nose guards are elongated sleeves with a channel therein to receive the edge of the board and the guard sleeve extends around the tip of the snow board. However, these bumpers add to the bulk of the board tip and can adversely affect performance during various trick maneuvers with the board.

Accordingly, there is a need for a ski and snow board tip protector that reduces the potential for tip delaminations without reducing board performance and without substantially changing the board tip profile.

SUMMARY OF THE INVENTION

The primary object of the invention is to provide a tip protector for a snow board or ski which reduces the likelihood of delaminations of the tips of the board or ski.

It is another object of the invention to provide a snow board tip protector that is integrated into the overall snow board design during manufacture.

It is another object of the invention to provide a tip protector that strengthens the tip portion of the snow board or ski without substantially changing the board weight or performance characteristics.

A tip protector in accordance with the present invention basically comprises a strip layer of reinforcing material such as a metal integrated into the top surface layer of the tip portion of the snow board. This strip layer extends laterally around the tip of the top surface and preferably does not extend over the end edges of the laminated layers of the tip portion of the snow board. The metal layer is pressed into the top finish layer of the board and is bonded to the top layer with a suitable adhesive. A preferred embodiment of the tip protector is a strip of burnished aluminum bonded to the top layer of the tip portion of the snow board.

Other objects, features and advantages of the present invention will become apparent from a reading of the following detailed description when taken in conjunction with the accompanying drawing wherein a particular embodiment of the invention is disclosed as an illustrative example.

DETAILED DESCRIPTION OF THE INVENTION

Figure 1:
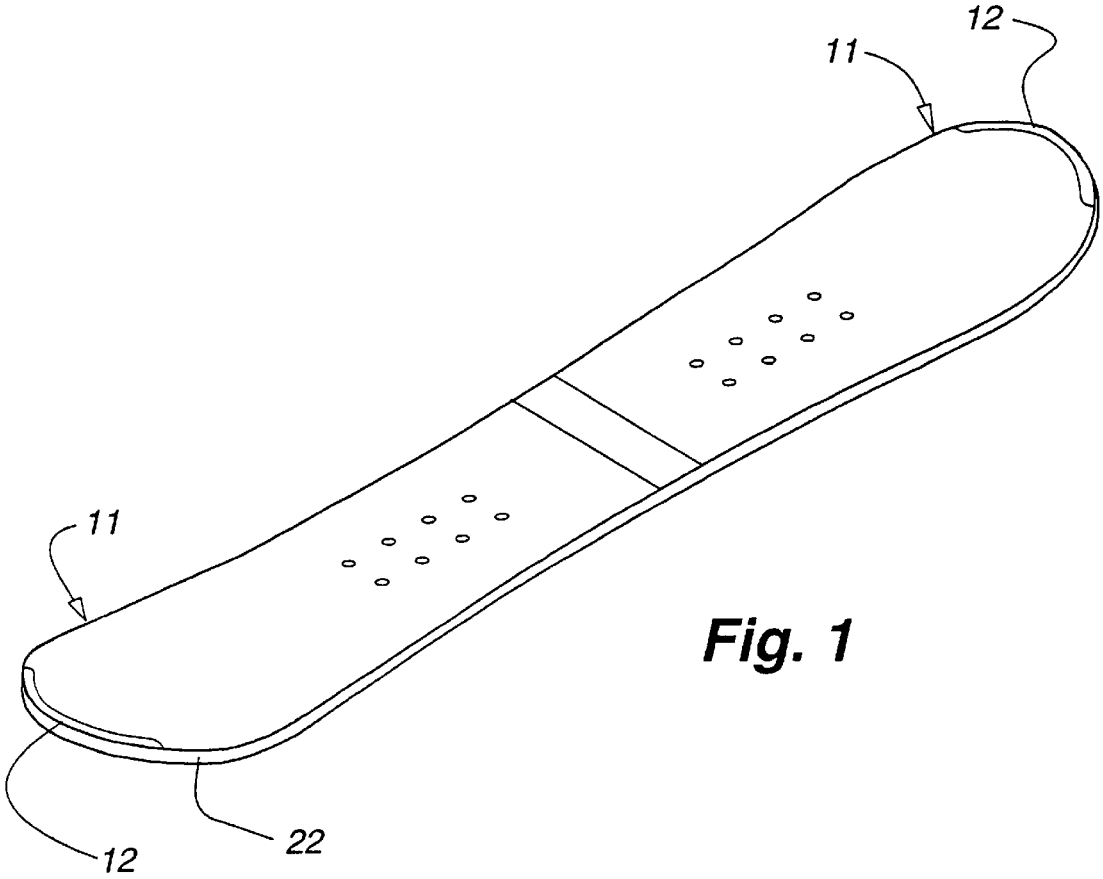
FIG. 1 is a perspective view of a snow board having the tip protector in accordance with the present invention installed on the opposite end portions of the board.
Figure 2:
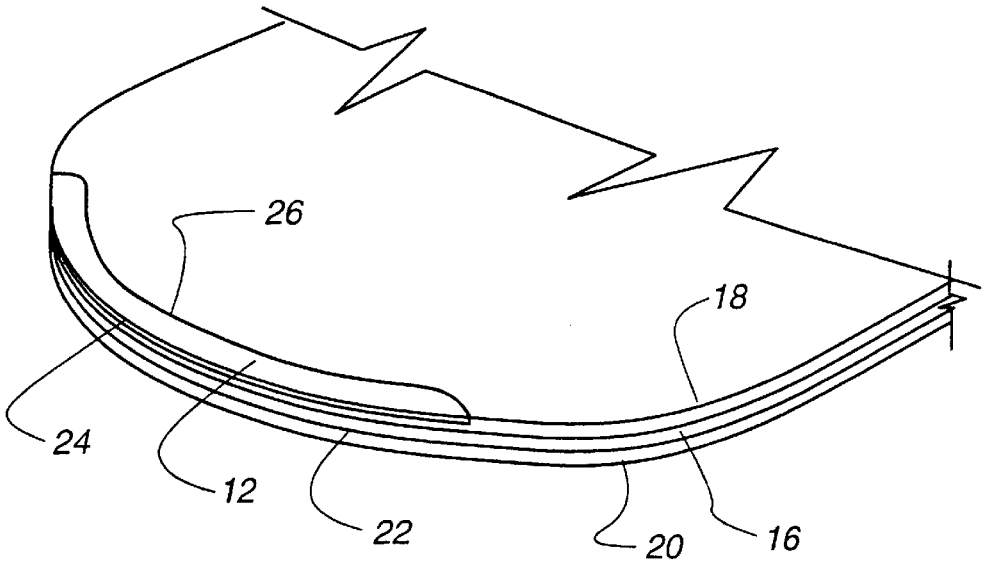
FIG. 2 is a partial enlarged view of one of the tip portions of the snow board shown in FIG. 1.
Figure 4:
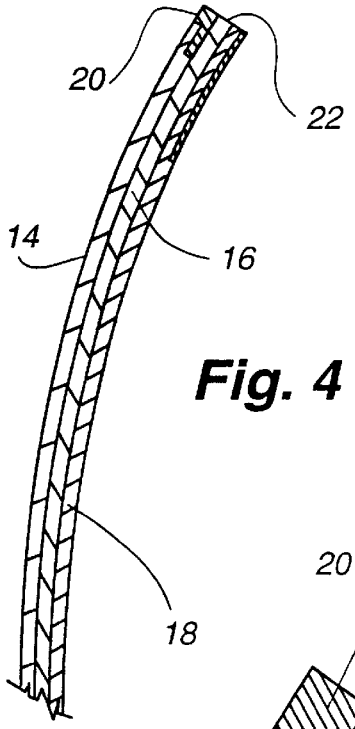
FIG. 4 is a sectional view of the tip portion of the snow board shown in FIG. 3 taken along the line 4—4.
Figure 5:
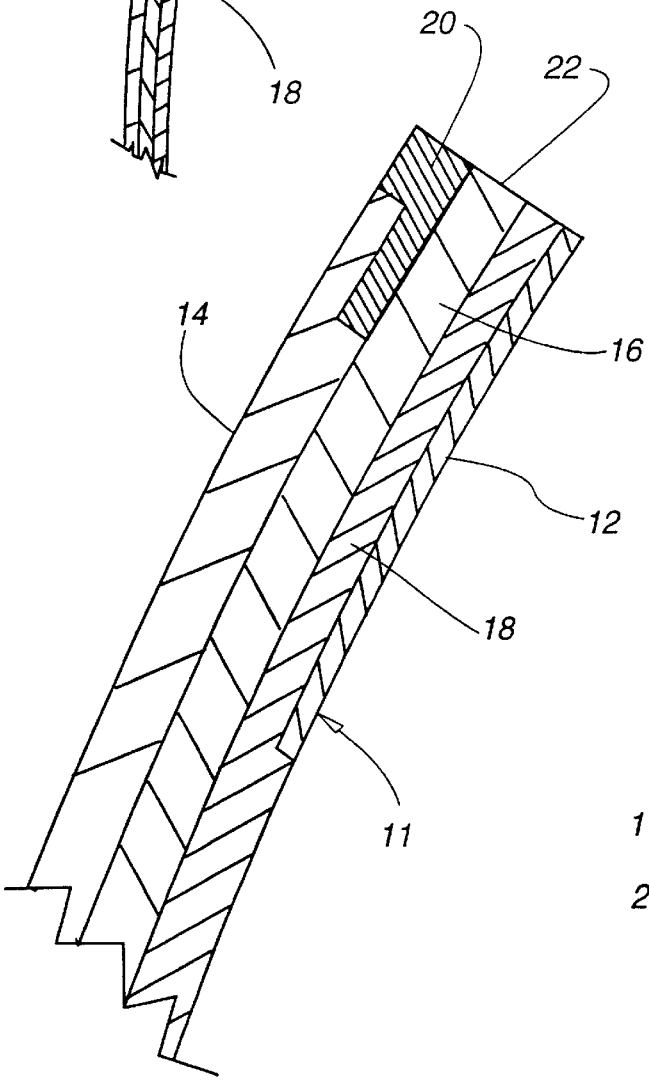
FIG. 5 is an enlarged view of the sectional view of the tip portion shown in FIG. 4.
Figure 3:
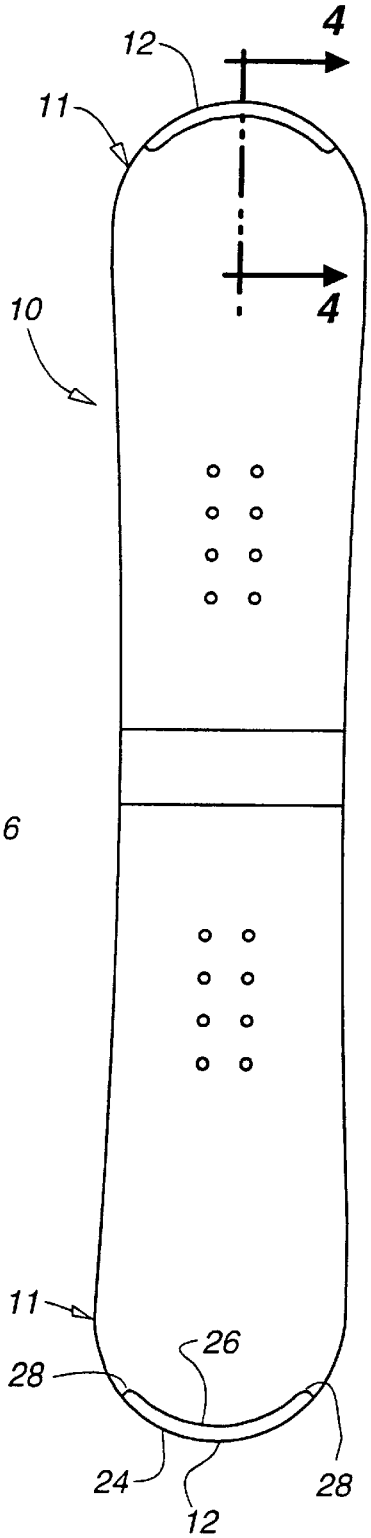
FIG. 3 is a plan view of the snow board shown in FIG. 1.

Referring now to the drawings, a snow board 10 incorporating a tip protector 12 in accordance with the present invention is shown in FIGS. 1 through 5. The snow board 10 is representative of a ski apparatus on which the tip protector 12 may be applied. The tip protector 12 may be also advantageously applied to other types of skis such as monoskis and pairs of skis that are composed of laminate composite layers of materials.

The typical snow board 10 is a generally flat, elongated board with upwardly curved tip portions 11. The board 10 is built up of multiple layers comprising a base layer 14 of plastic such as "P-Tex", a main body 16 comprised of a series of alternating epoxy laminate layers of materials such as precure glass sheets and fiberglass cloth over a light weight core material such as wood (not shown). A final top layer 18 of precure glass or epoxy covers the entire upper surface structure. The layers 14, 16, and 18 are preferably epoxied and/or thermally cured and bonded together to form a rigid, longitudinally flexible, board structure.

A metal edge 20 is embedded into the bottom or base layer 14 which preferably extends completely around the perimeter of the base layer 14 of the board 10. As can readily be seen from FIGS. 4 and 5, this metal edge has an "L" shaped cross section with the long leg sandwiched between the base layer 14 and adjacent layers 16. This metal edge 20 is critical to the carving performance of the board 10 and may extend only along the parallel sides of the board 10 or, as shown, extend entirely around the board tips 11 as well.

The tip protector 12 is embedded in and bonded to the top layer 18 of the tip portion 11 of the snow board 10. The tip protector 12 is preferably an arcuate strip of sheet aluminum and is preferably less than about one inch wide and more preferably about ⅝ inches wide, although other thicknesses and strip widths may be employed as well as other surface shapes. The outer edge 24 of the tip protector 12 preferably is aligned with the end edge 22 of each of the laminated layers 14, 16 and 18, as is shown in FIGS. 1, 2, 4 and 5, although it could optionally be extended over the edges of the tip portion 11 down to the metal edge 20.

It has been found that when the board 10 does not have the tip protector 12, the top layer 18 tends to begin to delaminate and begins to peel back from the underlying layers 16 when the tip portion 11 is impacted, for example, as when a rider hits a tree with the board. However, with the tip protector 12 incorporated into the top layer around the tip portion 11, the energy of impact is uniformly dissipated over the tip portion surface rather than being concentrated along the interface between the top layer 18 and underlying layer 16. Consequently, this simple addition to the end portions of a snow board or other ski device, substantially reduces the likelihood of tip delaminations occurring.

The tip protector 12 is preferably uniform in thickness, preferably less than about 0.025 inches, and may extend in width entirely across the tip portion 11. In addition, the tip protector may have any aesthetically pleasing outline such as a rounded arcuate shape as illustrated, or a decorative design shape. In a typical application, where the tip portion of the snow board is approximately 3/16 inch thick, the tip protector is preferably about 0.015 inch thick. Other thicknesses may be used, however, but thicker protectors add weight to the board 10. It is desirable to minimize the weight of the board without sacrificing performance. Therefore the weight of the tip protector should be minimized and therefore thicker tip protectors 12 are less desirable. The tip protector 12 on the snow board 10 preferably has an arcuate outer edge 24 matching the curvature of the board tip and a generally parallel inner edge 26 which are joined by rounded ends 28. Rounded ends 28 are preferred as sharp corners may tend to create stress concentrators under impact loads.

The present invention may be practiced otherwise than as specifically described above. Many changes, alternatives, variations, and equivalents to the various structures shown and described will be apparent to one skilled in the art. For example, the protector may have a different shape than the arcuate or crescent shape that is shown or it may have a different thickness or width. The protector 12 may incorporate a decorative design along its inboard edge and/or in its upper surface and it may also extend over the outer edge 22 of the board 10. The top layer 18 may be thick or thin and the inboard edge 26 and outboard edge 24 of the protector 12 may have different curvatures. The protector 12 may be made of any flexible, stress spreading material such as a ductile metal or plastic material as well as composite materials.

Accordingly, the present invention is not intended to be limited to the particular embodiment illustrated but is intended to cover all such alternatives, modifications, and equivalents as may be included within the spirit and broad scope of the invention as defined by the following claims. All patents, patent applications, and printed publications referred to herein are hereby incorporated by reference in their entirety.

What is claimed is:

1. A tip protector adapted for use on a snow ski device during use, the ski device having a tip portion, an upper tip surface and a tip portion edge, said protector comprising:

a continuous curved strip of ductile planar sheet material sized to fit onto and be attached to said upper tip surface on said tip portion of said ski device, said strip having a top surface and said strip having an edge portion positioned coextensively with said tip portion edge, said strip embedded in said upper tip surface so that substantially the entirety of said top surface of said strip is exposed, said sheet material deforming upon impact to protect against delamination of said upper tip surface.

2. The tip protector according to claim 1 wherein said protector is made of aluminum.

3. The tip protector according to claim 1 wherein said protector has an arcuate outer edge and an arcuate inner edge spaced from said outer edge by a width defined along the top surface of said strip so that energy from an impact between the tip portion of the ski device and an object is partially dissipated along the tip protector.

4. The tip protector according to claim 3 wherein said edges are connected together by rounded corners.

5. The tip protector according to claim 3 wherein said width is less than one inch.

6. The tip protector according to claim 5 wherein said width is about 5/8 inch.

7. The tip protector according to claim 6 wherein said thickness is less than 0.025 inches.

8. A snowboard comprising:

an elongated laminated flat body having opposing upwardly curved and rounded tip portions, said laminated body having a base layer and a top layer having an upper surface and an edge around said tip portions; and a continuous curved planar tip protector bonded to a portion of said upper surface of at least one of said rounded tip portions coextensive to and along a substantial length of said edge, said tip protector having an upper surface defining an arcuate outer edge and an arcuate inner edge spaced from said outer edge by a width defined along the top surface of said tip protector, said entire top surface exposed so that energy from an impact between one of said tip portions of the snow board and an object is at least partially dissipated along the tip protector to keep said upper surface from delaminating.

9. The snow board according to claim 8 wherein said tip protector is a strip of metal sheet material.

10. The snow board according to claim 8 wherein said tip protector is a strip of ductile sheet material.

11. The snow board according to claim 10 wherein said strip has an edge aligned with said edge of said tip portion.

12. A snow skiing device adapted to be fastenable to at least one foot of a rider, said device comprising:

an elongated, laminated body having at least one upwardly curved tip portion, said laminated body having a base layer and a top layer having an upper surface and an edge around said tip portion; and a tip protector bonded to a portion of said upper surface of said tip portion coextensive with said edge, said tip protector having a width and defining a bottom interface surface and a top surface, said top surface being coextensive with said width of said protector, said tip protector embedded in said tip portion so that said bottom interface surface is embedded below the level of said top layer of said snow skiing device, with the entirety of said top surface being exposed, said tip protector deforming upon impact to protect against delamination of said top layer.

13. The skiing device according to claim 12 wherein said tip protector is a strip of planar sheet metal.

14. The skiing device according to claim 13 wherein said device is a snow board having opposing end tip portions, each of said tip portions having a tip protector embedded in said upper surface.

15. The device according to claim 14 wherein said tip protectors are made of sheet metal material.

16. The device according to claim 15 wherein each of said tip protectors is a strip of sheet aluminum.

17. The device according to claim 16 wherein each said strip has an edge aligned with said edge of said tip portion.

18. The device according to claim 17 wherein said tip protector strip has a thickness of less than 0.025 inches.

19. The device according to claim 18 wherein said tip protector thickness is about 0.015 inches.

* * * * *